United States Patent [19]

Coppelman

[11] Patent Number: 4,480,885

[45] Date of Patent: Nov. 6, 1984

[54] PRINTED CIRCUIT BOARD INTERCONNECTION SYSTEM

[75] Inventor: Maurice A. Coppelman, Framingham, Mass.

[73] Assignee: Honeywell Information Systems Inc., Waltham, Mass.

[21] Appl. No.: 467,002

[22] Filed: Feb. 16, 1983

[51] Int. Cl.[3] ..... H01R 13/62

[52] U.S. Cl. ..... 339/45 M; 339/17 M; 29/829; 29/845; 29/830

[58] Field of Search ..... 339/45, 46, 17 LM, 17 M, 339/75, 103; 29/829, 830, 832, 836, 837, 845

[56] References Cited

U.S. PATENT DOCUMENTS

| | | | |
|---|---|---|---|
| 2,474,988 | 7/1949 | Sargrove | 29/830 |
| 3,769,702 | 11/1973 | Scarbrough | 29/830 |
| 4,058,890 | 11/1977 | Pierce et al. | 29/829 |
| 4,133,592 | 1/1979 | Cobaugh et al. | 339/17 M |
| 4,168,877 | 9/1979 | Little et al. | 339/103 M |
| 4,235,496 | 11/1980 | Aug et al. | 339/45 M |
| 4,410,222 | 10/1983 | Enomoto et al. | 339/45 M |
| 4,414,606 | 11/1983 | Anderson et al. | 29/829 |

FOREIGN PATENT DOCUMENTS

| | | | |
|---|---|---|---|
| 401070 | 1/1973 | U.S.S.R. | 29/830 |

OTHER PUBLICATIONS

"Experimental Circuit Cards", R. A. Faust IBM, vol. 24, No. 1B, Jun. 1981, pp. 698–701.

*Primary Examiner*—John McQuade
*Assistant Examiner*—David L. Pirlot
*Attorney, Agent, or Firm*—Faith F. Driscoll; Nicholas Prasinos

[57] ABSTRACT

A printed circuit board interconnection system interconnects a pair of printed circuit boards in parallel planes so that all of the board components can be assembled in a standard fashion using standard connectors. The system includes an assembly having a spacer member positioned between the two circuit boards and a pair of ejector members which attach to each end of the spacer member. Each ejector member includes vertical and horizontal arm portions positioned to provide a predetermined mechanical advantage for separating the connectors mounted on each board as standard components.

22 Claims, 8 Drawing Figures

PRINTED CIRCUIT BOARD INTERCONNECTION SYSTEM

BACKGROUND OF THE INVENTION

1. Field of Use

The present invention relates to electrical connectors and more particularly to connectors for use with printed circuit boards.

2. Prior Art

In certain applications, it becomes desirable to be able to connect two printed circuit boards together. In general, this is accomplished by mounting or interconnecting the two boards solder side to component side. One connector is wave soldered to one board while the other connector is hand soldered to the underside or solder side of the other board. The step of hand soldering, in addition to being time consuming, was found to introduce difficulties in assembly and testing operations.

In addition to the above, it has been found that because of the high pin counts normally used with data processing printed circuit boards, it has been found that the printed circuit board connectors once engaged are difficult to disengage. Because the mating connectors are mounted on different printed circuit boards, pulling them apart during disengaging can often result in damage to the pins.

Accordingly, it is a primary object of the present invention to provide an assembly for interconnecting two printed circuit boards which can be easily disengaged without damage to mating connectors.

It is a further object of the present invention to provide an assembly which can be constructed with a minimum of steps.

SUMMARY OF THE INVENTION

The above objects and advantages are achieved in the preferred embodiment of the spacer-ejector assembly and interconnection method of the present invention. The spacer-ejector assembly interconnects a pair of printed circuit boards through standard connectors in parallel planes so that the components on each board face one another. That is, the assembly and method permits male and female connectors to be mounted in a standard fashion on a printed circuit board like the other components on the board. This eliminates the necessity for hand soldering one of the connectors on the solder or circuit board pattern side of one printed circuit board thereby eliminating assembly and testing difficulties.

The assembly includes a spacer member positioned between the two printed circuit boards and a pair of identical ejector members, each of which is mounted beneath, attaches to and brackets one end of the spacer member. The spacer member takes the form of a rectangular box and has at each end a pair of legs which extend out slightly at the sides of the box. The spacer member fits on top of and its dimensions are large enough to span the body of a double pin sided male connector. The top of the spacer member has sets of holes through which the pins on one side of the male connector pass through. The same pins also pass through holes drilled in one of the printed circuit boards and are wave soldered with the other components on that board.

The pins on the other side of the male connector engage the female or mating connector which is mounted on the other printed circuit board. The mating connector is wave soldered with the other components on that board.

According to the present invention, both ejector members are elbow like in shape and are wide enough to bracket the ends of the spacer member. The outsides of each ejector member have protrusions as part of the molding which snap into receiving holes in each pair of spacer legs thereby forming axes about which the ejector members can be moved. The bottom portion of each ejector member is cut away so that the ejector member brackets the spacer member. The vertical and horizontal arm portions of each ejector member are so positioned relative to one another to provide a desired amount of mechanical advantage within the space limitations of the two printed circuit boards. That is, when the vertical arm portions or back of both ejector members are moved to the maximum limit of vertical travel, the mechanical advantage translates this into a downward force at each end of the horizontal arm portion of the side of each ejector which is applied to one of the printed circuits producing the required separation distance between the pair of printed circuit board connectors for proper disconnection. Because the ejector members extend equal force on the printed circuit board along both sides of the spacer member rather than on the connector pins, the connectors are disconnected without any pin damage.

The preferred embodiment of the present invention permits connectors to be easily disengaged by squeezing or moving by hand the vertical arm portions of both ejector members to their maximum vertical position. The selected mechanical advantage which is at least in the ratio of 2 to 1 permits relatively little force to be used to accomplish disengagement. As the connectors are reassembled, the ejector members automatically return to their initial position.

Additionally, the connector assembly of the preferred embodiment is easily and inexpensive to construct. It uses standard connectors and is easy assembled. By including shaft like protrusions as part of the ejector molding and holes as part of the spacer molding, a minimum of parts is required for construction and assembly.

The novel features which are believed to be characteristic of the invention, both as to its organization and method of operation, together with further objects and advantages will be better understood from the following description when considered in connection with the accompanying drawings. It is to be expressly understood, however, that each of the drawings are given for the purpose of illustration and description only and are not intended as a definition of the limits of the present invention.

DETAILED DESCRIPTION OF THE PREFERRED EMBODIMENT

Figure 1:
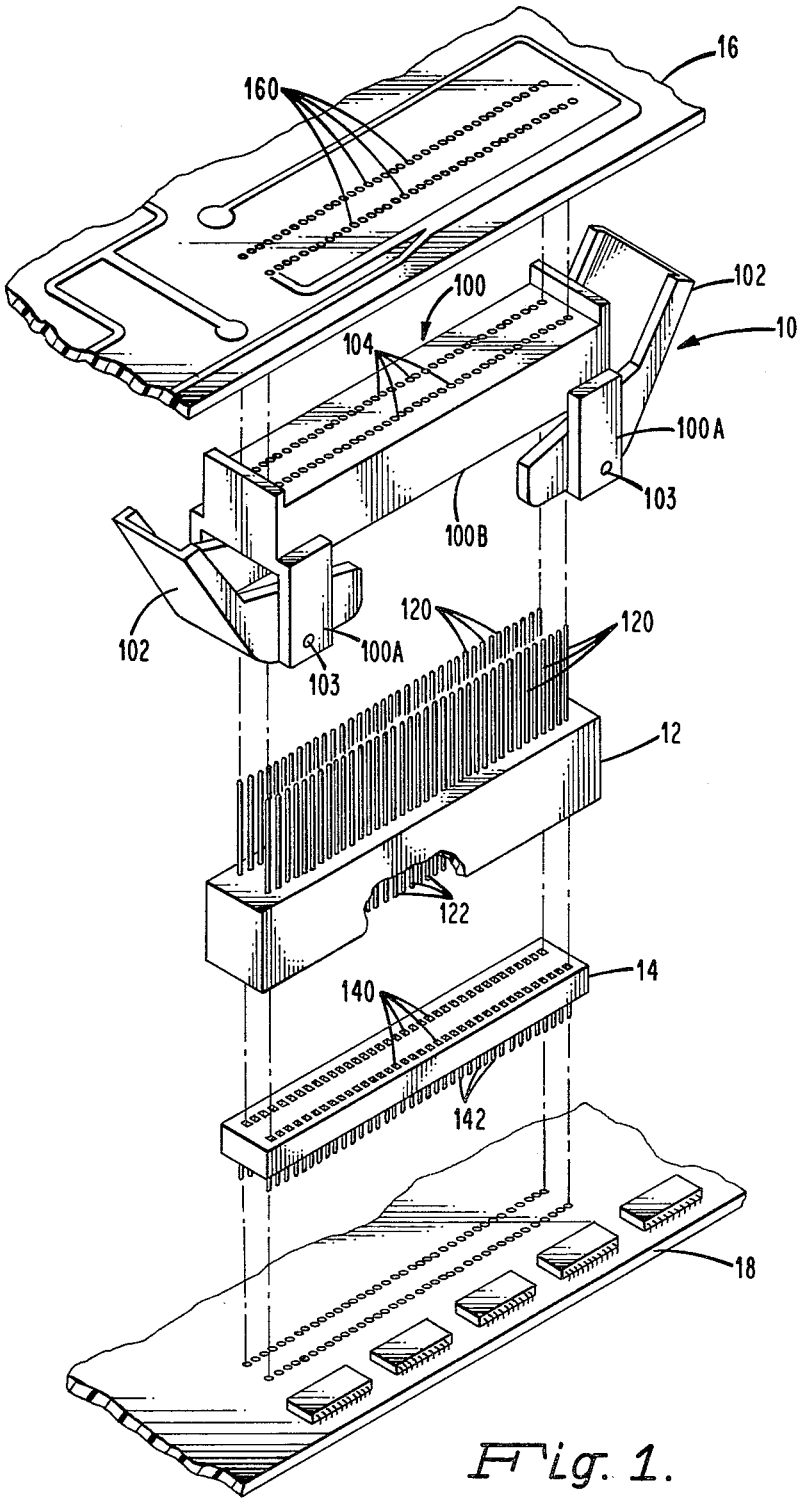
FIG. 1 is an isometric view of the spacer-ejector assembly of the present invention illustrating its use in interconnecting a pair of printed circuit boards.

FIG. 1 is an isometric view of the connector assembly 10 of the present invention illustrating how it is assembled for interconnecting a pair of printed circuit boards 16 and 18. The printed circuit boards may be mounted in a horizontal or vertical position.

As seen from the Figure, the assembly includes a spacer member 100 and two ejector members 102. Each ejector member 102 is positioned at a different end of spacer member 100 and is attached to the pair of legs 100A by means of a pair of cylindrical posts 103 included as part of the ejector member. During assembling, the posts 103, molded as part of the sides of each ejector member 102, are snapped or pressed into the holes 101 in the legs of the spacer member 100.

The connection of the printed circuit boards 16 and 18 is made through standard male and female connectors 12 and 14, mounted in a standard fashion with the spacer-ejector assembly 10. That is, the connector 12 is a double pin sided male connector termed a "male pin box header" which is conventional in design. For example, it may take the form of standard connectors manufactured by AMP Incorporated, such as those described in the catalog titled "AMP Engineering and Purchasing Guide, Edition 4, Catalog Number 4401-8, published by AMP Incorporated, Copyright 1979.

Figure 2A:
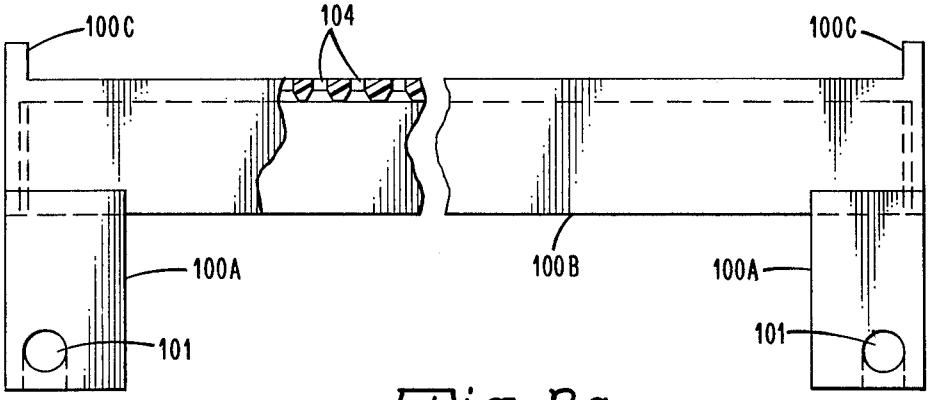
FIGS. 2*a* through 2*c* show side, top and end views of the spacer member of the device of the present invention.
Figure 2B:
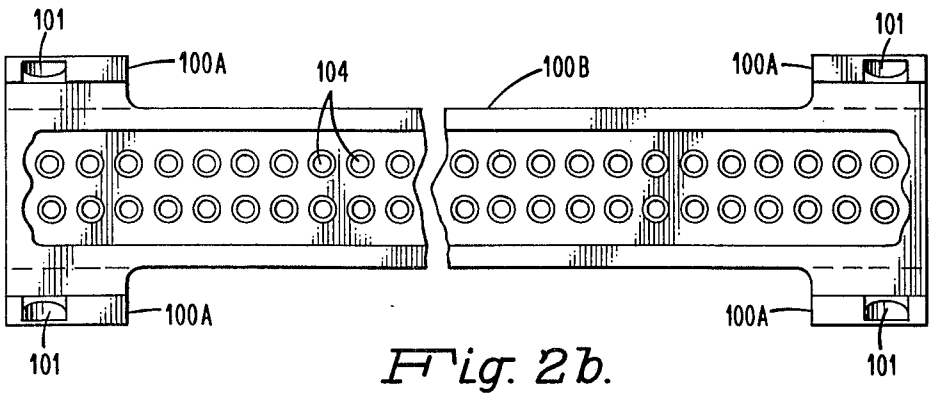
Figure 2C:
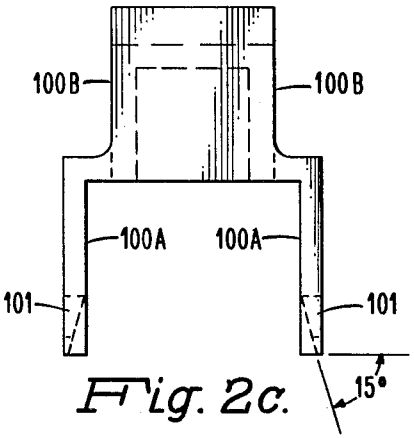

The two rows of pins 120 of the underside of the connector 12 pass through two rows of holes 104 on a spacer member 100 of assembly 10. The dimensions of the spacer member 100 shown in detail in FIGS. 2*a* through 2*c* are large enough to house the body of connector 12. Thus, when the connector 12 is in its correct position, the pins 120 of connector 12 also pass through the two rows of holes 160 of board 16. Like the other components mounted on board 16, the pins 120 of connector 12 are wave soldered to the board is conductive circuit board pattern, as shown in FIG. 1.

In a similar fashion, the pins 142 of a standard female or mating connector 14 mounted on printed circuit board 18 are wave soldered to the conductive circuit pattern of the board like the other components mounted on the board. Since the conductive circuit board pattern is located on the underside of board 18, it is not shown in FIG. 1. The boards 16 and 18 are interconnected by inserting the pins 122 on the top side of connector 12 into the two rows of holes 140 of mating connector 14.

Spacer Member 100

Now considering the spacer-ejector assembly 10 in greater detail, it is seen from FIGS. 2*a* through 2*c* that the body of the spacer member 100 takes the form of a rectangular box which acts as a spacer for the two printed circuit boards in conjunction with connector 12. The spacer member 100 is molded to include the two pairs of legs 100*a* which extend outward from sides 100B to provide sufficient clearance between the body of connector 12 and both ejector members 102. As seen from FIG. 2*c*, the legs 100A have receiving holes 101 which are ramped or tapered at 15 degrees, as shown. This permits easy assembly of the ejector posts 103 which are snapped into the receiving holes 101.

The spacer member 100 is constructed from plastic material such as thirty percent glass filled nylon material manufactured under the name "Nylafil" by Fiberfil Inc. In addition to the four receiving holes 101 in legs 100A, the top of spacer member 100 contains two rows of 30 holes 104 sized to accommodate the pins 120 of connector 12. The walls of the sides 100B, top and ends of the rectangular spacer member are all the same thickness (i.e., 0.06 inches). As seen from FIG. 2*a*, the walls 100C at each end of the spacer member 100 extend above (i.e., 0.03 inches) the spacer sides 100B to allow for cleaning during the wave soldering operation.

Ejector Member 102

Figure 3B:
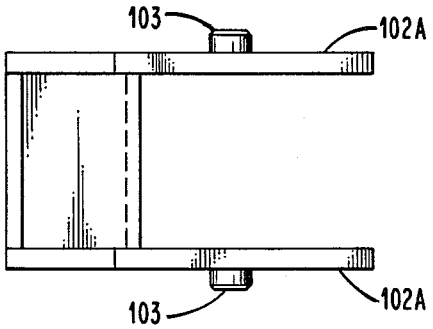
FIGS. 3*a* through 3*c* show side, top and end views of the ejector member of the assembly of the present invention.
Figure 3A:
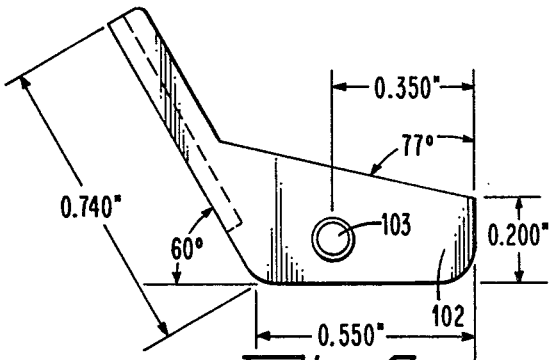
Figure 3C:
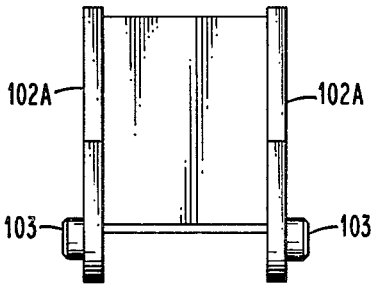

FIGS. 3*a* through 3*c* show different views of ejector member 102. As shown in FIG. 3*b*, the sides 102A and the back of the ejector member have a U shape whose opening is wide enough to bracket or fit around one end of connector member 12. The walls of the sides and back of each ejector member are of the same thickness. As seen from FIG. 3*a*, the sides 102A of the ejector member 102 are elbow like in shape. The vertical and horizontal arm portions of each member side 102A are so positioned to one another to provide a desired mechanical advantage within the space requirements of the two printed circuit boards. That is, as seen in FIG. 3*a*, the length of the vertical arm portion at the selected angle of inclination (i.e., 60 degrees) is 0.74 inches while the horizontal arm portion measured from the post 103 is 0.35 inches.

The above provides approximately a 2 to 1 mechanical advantage when the ejector member is moved about the axis shown in FIGS. 3*b* and 3*c*. That is, when each ejector member 102 is attached to the spacer member 100 by mounting posts 103, it moves or rotates about the axis which passes through the posts 103 and receiving holes 101 and applies a downward force at the end of the horizontal arm portion of member 102. However, the length of the vertical arm portion of the ejector member 102 is selected so that when the arm reaches its limit of travel (i.e., vertically positioned), the two connectors 12 and 14 are separated sufficiently to be disconnected. Additionally, the length of the vertical arm when so positioned is less than the height of the spacer member 100. Thus, it does not exceed the spacing between printed circuit boards.

As seen from FIGS. 3*b* and 3*c*, each side 102A of the ejector member 102 has a cylindrical mounting post appropriately positioned to provide the above discussed 2 to 1 mechanical advantage. The mounting posts are molded into the sides of each ejector member 102. When the ejector member is snapped into the receiving holes of the spacer member 100, the combination provides an axis about which the ejector member 102 can be moved or rotated. The mounting posts by being included as part of the ejector side moldings, provide an inexpensive and effective means of construction and assembly.

Each ejector member 102 is constructed of the same plastic material as spacer member 100. As seen from FIG. 3*a*, both ends of the horizontal arm portion of ejector member 102 are rounded with radiuses shown. This ensures that the ejector member 102 does not dig into the surface of printed circuit board 18.

DESCRIPTION OF OPERATION

Figure 4:
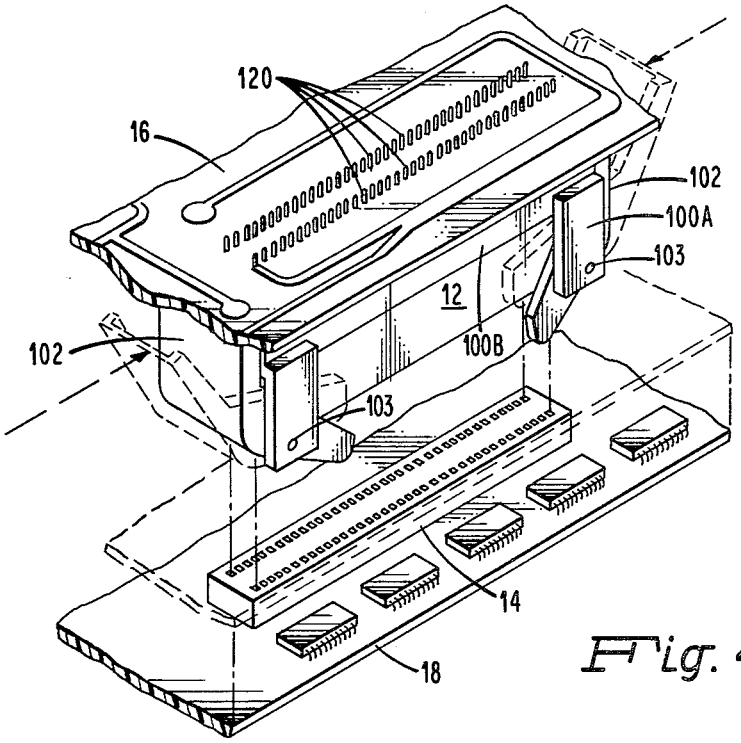
FIG. 4 illustrates the operation of the assembly of the present invention when disconnecting the pair of printed circuit boards according to the present invention.

With reference to FIG. 4, the manner in which the spacer ejector assembly 10 of the present invention is used to disconnect printed circuit boards 16 and 18. First of all, it is assumed that the assembly 10 has been assembled so that the pins 120 of connector 12 are soldered to printed circuit board 16 while the pins 122 of the connector have been inserted into mating connector 14 which has been soldered to printed circuit board 18.

As seen from FIG. 4, by exerting forces on the vertical arm portions of both ejector members 102, the ejector members 102 are moved from their initial positions, shown in dotted lines, in the directions of the arrows, to a maximum vertical position, as shown. This simultaneously produces downward forces at the ends of all four of the horizontal arm portions of the ejector members 102. These evenly applied forces to the component side of printed circuit board 18 cause the separation of the two connectors 12 and 14, as shown. That is, the connector 14 and board 18 are moved from an initial position shown in dotted lines to the final position shown providing the desired separation distance which corresponds to approximately one-half the width of connector 14 (i.e., hole depth). With this separation, the connectors can be completely disconnected without any damage to the pins 122 of connector 12.

It has been found that both ejector members can be squeezed with relative ease to the same vertical position using the forefinger and thumb of one hand. With the 2 to 1 mechanical advantage, only a small amount of hand exerted pressure or force is required to separate the connectors. The ejector members 102 automatically return to their initial positions as the connectors are reengaged.

The above has described a preferred embodiment of the ejector spacer assembly and interconnection method of the present invention which permits a pair of printed circuit boards to be interconnected in parallel planes with the components on each board facing each other. The assembly is combined with standard mating connectors which are mounted on the printed circuit boards as standard components. Thus, the assembly of the invention eliminates the step of hand soldering a connector to one printed circuit board. More importantly, the ejector spacer assembly permits connectors with high pin density to be easily disengaged by applying forces evenly to one of the printed circuit boards near the sides of the mating connector by simply squeezing the pair of ejector members of the assembly. This causes a separation of the two connectors without pin damage.

It will be obvious to those skilled in the art that changes may be made to the preferred embodiment of the present invention without departing from its teachings. For example, changes may be made to the ejector members to provide a different mechanical advantage. Also, the pin density of the standard connectors may be increased or decreased as required. Different types of plastic material may be used in the construction of the ejector and spacer members. Further, other pinning arrangements may be used for attaching the ejector members to the spacer member legs.

While in accordance with the provisions and statutes there has been illustrated and described the best form of the invention, certain changes may be made without departing from the spirit of the invention as set forth in the appended claims and that in some cases, certain features of the invention may be used to advantage without a corresponding use of other features.

What is claimed is:

1. An assembly for interconnecting a pair of printed circuit boards for easy disconnection, each of said printed circuit boards having component and solder sides wherein the pins of a double pin connector pass through said assembly, portions of said pins on one side of said double pin connector are solderable to the solder side of one of said printed circuit boards and the pin portions on the other side of said connector are insertable into a mating connector which is solderable to the solder side of the other printed circuit board so that the component side of both boards face each other, said assembly comprising:

a spacer member being shaped for housing said double pin connector, said spacer member having top, end and side walls, said top wall having a plurality of holes through which said pins of said double pin connector pass through, each side wall having a support leg at each end extending outward from said side wall by a predetermined amount; and a pair of identically constructed ejector members, each ejector member having side and back walls molded in a predetermined shape, each of said ejector member side walls being elbow like in shape having vertical and horizontal arm portions, and said ejector members including means for attaching said ejector members to said end walls of said spacer member and said vertical portions of said ejector members when simultaneously moved in a vertical direction to a maximum vertical position producing downward forces at the ends of said horizontal arm portions of said ejector members onto said other printed circuit board causing damage free separation of said connectors.

2. The assembly of claim 1 wherein said predetermined shape corresponds to a substantially U-shape.

3. The assembly of claim 1 wherein said downward forces are evenly applied in longitudinal directions along said other printed circuit board to provide a predetermined separation distance between said connectors for said easy disconnection.

4. The assembly of claim 1 wherein each of said legs has a receiving hole and wherein said means for attaching includes a mounting post located at a predetermined point on said horizontal arm portion of each of said ejector members, said mounting posts being snapped into said receiving holes of said support legs.

5. The assembly of claim 4 wherein the lengths of said vertical and horizontal arm portions of each ejector side measured relative to said mounting post approximates a ratio for providing a predetermined mechanical advantage.

6. The assembly of claim 5 wherein said predetermined mechanical advantage is at least 2 to 1.

7. The assembly of claim 5 wherein each vertical arm portion of said ejector side is positioned at a predetermined angle relative to said horizontal arm portion for providing said predetermined mechanical advantage.

8. The assembly of claim 7 wherein said predetermined angle approximates 60 degrees.

9. The assembly of claim 4 wherein said end walls of said spacer member extend a predetermined amount above said top wall so as to allow cleaning during the soldering of said double pin connector.

10. The assembly of claim 9 wherein the length of said vertical arm portion when in said maximum vertical position does not exceed a spacing between said pair of printed circuit boards.

11. The assembly of claim 1 wherein said spacer member and said ejector members are molded from plastic materials.

12. The assembly of claim 11 wherein said plastic material is glass filled nylon material.

13. The assembly of claim 4 wherein said receiving holes are tapered to form a predetermined angle so as to permit easy assembly of said ejector posts therein.

14. The assembly of claim 13 wherein said predetermined angle approximates fifteen degrees.

15. An assembly for interconnecting a pair of printed circuit boards for damage free disconnection, each of said printed circuit boards having component and solder sides, one of said printed circuit boards including a mating connector having a number of rows of holes on a top side and a corresponding number of rows of pins on a bottom side, said mating connector being mounted on one of said component sides with said number of rows of pins soldered to one of said solder sides, said assembly comprising:

a connector having a number of rows of pins on a top and bottom side, said connector being rectangular in shape and having top, end and side walls with predetermined dimensions;

a rectangular box shaped spacer member having top, end and side walls with dimensions greater than said predetermined dimensions for housing said connector, said top wall having a plurality of holes through which said number of rows of pins of said top of said connector pass through and are soldered to said solder side of one of said printed circuit boards, each spacer member side wall having a support leg at each end extending outward from said member side wall by a predetermined amount and each said leg having a receiving hole; and a pair of identically constructed ejector members, each ejector member having side and back walls molded in a substantially U-shape, each of said ejector member side walls being elbow like in shape having vertical and horizontal arm portions, and a mounting post located at a predetermined point on said horizontal arm portion, said ejector members being coupled to said ends of said spacer member by snapping said mounting posts into said receiving holes of said support leg and said vertical portions of said ejector members when simultaneously moved in a vertical direction to a maximum vertical position producing downward forces at the ends of horizontal arm portions of said ejector members onto said other printed circuit board causing damage free separation of said number of rows of pins on said bottom of said connector from said number of rows of holes of said mating connector.

16. The assembly of claim 15 wherein said downward forces are evenly applied in longitudinal directions along said other printed circuit board to provide a predetermined separation distance between said connectors for said easy disconnection.

17. The assembly of claim 15 wherein the lengths of said vertical and horizontal arm portions of each ejector member side wall measured relative to said mounting post approximates a ratio for providing a predetermined mechanical advantage.

18. The assembly of claim 17 wherein said predetermined mechanical advantage is at least 2 to 1.

19. The assembly of claim 17 wherein each vertical arm portion of said ejector side is positioned at a predetermined angle relative to said horizontal arm portion for providing said predetermined mechanical advantage.

20. The assembly of claim 19 wherein said predetermined angle approximates 60 degrees.

21. A method of interconnecting a pair of printed circuit boards for damage free separation during disconnection, each of said printed circuit boards having component and solder sides, said method comprising the steps of:

(a) mounting on the component side of one of said printed circuit boards a mating connector which is soldered on the solder side of said one printed circuit board;

(b) positioning a rectangular shaped spacer member having top, end and side walls with predetermined dimensions adjacent to said component side of the other one of said printed circuit boards, said top wall having a plurality of holes and each side wall having a leg at each end extending outward from said side wall by a predetermined amount and each said leg including a receiving hole;

(c) passing a plurality of pins on the top of another connector through said plurality of holes of said spacer member top wall and soldering said plurality of pins to the solder side of said other printed circuit board;

(d) attaching at each end of said spacer member a pair of identically constructed ejector members by snapping mounting posts into said receiving holes of the spacer member legs located at predetermined points on horizontal arm portions of the elbow shaped sides of each ejector member; and, (e) inserting a plurality of pins on the bottom of said another connector into a plurality of holes on the top of said mating connector completing the interconnection of said printed circuit boards.

22. The method of claim 21 wherein said method further includes the step of simultaneously moving vertical portions of the sides of each ejector member to a maximum vertical position so as to produce downward forces at the ends of horizontal arm portions of said ejector members onto said other printed circuit board causing damage free separation of said connectors.

* * * * *